US010208263B2

(12) United States Patent
Kong

(10) Patent No.: US 10,208,263 B2
(45) Date of Patent: Feb. 19, 2019

(54) MODULAR HYBRID PLASMA GASIFIER FOR USE IN CONVERTING COMBUSTIBLE MATERIAL TO SYNTHESIS GAS

(71) Applicant: Cogent Energy Systems, Inc., Annandale, VA (US)

(72) Inventor: Peter Chuen Sun Kong, Idaho Falls, ID (US)

(73) Assignee: Cogent Energy Systems, Inc., Merrifield, VA (US)

( * ) Notice: Subject to any disclaimer, the term of this patent is extended or adjusted under 35 U.S.C. 154(b) by 0 days.

(21) Appl. No.: 15/248,357

(22) Filed: Aug. 26, 2016

(65) Prior Publication Data

US 2017/0058220 A1 Mar. 2, 2017

Related U.S. Application Data

(63) Continuation of application No. 62/210,979, filed on Aug. 27, 2015.

(51) Int. Cl.
*C10J 3/72* (2006.01)
*C10J 3/74* (2006.01)

(52) U.S. Cl.
CPC . *C10J 3/72* (2013.01); *C10J 3/74* (2013.01); *C10J 2300/0916* (2013.01); *C10J 2300/1238* (2013.01)

(58) Field of Classification Search
CPC combination set(s) only.
See application file for complete search history.

(56) References Cited

U.S. PATENT DOCUMENTS 3,449,628 A * 6/1969 Cann ..... H05H 1/40 313/161
3,453,474 A * 7/1969 Cann ..... H05H 1/40 313/161
4,013,867 A 3/1977 Fey
4,682,005 A * 7/1987 Marhic ..... H05H 1/34 219/121.48
4,801,435 A * 1/1989 Tylko ..... B01J 19/088 219/121.36
4,958,057 A * 9/1990 Shiraishi ..... H05H 1/34 219/121.48
6,008,464 A * 12/1999 Donnart ..... H05H 1/36 219/121.48
6,475,215 B1 * 11/2002 Tanrisever ..... A61B 18/042 606/32
7,411,353 B1 8/2008 Rutberg et al.
7,832,344 B2 * 11/2010 Capote ..... F23G 5/085 110/229

(Continued)

*Primary Examiner* — Kaity V Chandler
(74) *Attorney, Agent, or Firm* — LaMorte & Associates, P.C.

(57) ABSTRACT

A hybrid plasma reactor system that uses multiple sets of long electrodes that are placed longitudinally opposite each other within modular plasma units. The plasma units can be stacked to form an elongated plasma zone. The electrode assemblies extend into access ports. Each of the electrode assemblies has an electrode tip mounted in a tubular support jacket. A gas conduit for a supplied working gas surrounds at least a portion of the tubular support jacket. An arc is created at the electrode tip. A working gas flows through the gas conduit and is directed into the arc, therein creating plasma within the internal plasma zone.

6 Claims, 5 Drawing Sheets

(56) References Cited

U.S. PATENT DOCUMENTS

| | | | | |
|---|---|---|---|---|
| 8,492,979 | B2 | 7/2013 | Ganireddy et al. | |
| 2004/0020900 | A1* | 2/2004 | Wu | H05H 1/34 219/121.5 |
| 2005/0115933 | A1* | 6/2005 | Kong | H05H 1/44 219/121.57 |
| 2006/0049150 | A1* | 3/2006 | Severance, Jr. | H05H 1/34 219/121.52 |
| 2008/0093346 | A1* | 4/2008 | Yamaguchi | H05H 1/28 219/121.49 |
| 2008/0217305 | A1* | 9/2008 | Sanders | H05H 1/28 219/121.49 |
| 2009/0261081 | A1* | 10/2009 | Girold | H05H 1/34 219/121.49 |
| 2012/0138584 | A1* | 6/2012 | Ashtekar | H05H 1/28 219/121.52 |
| 2012/0246922 | A1* | 10/2012 | Hussary | H05H 1/28 29/825 |
| 2013/0277337 | A1* | 10/2013 | Murata | B23K 9/167 219/74 |

* cited by examiner

MODULAR HYBRID PLASMA GASIFIER FOR USE IN CONVERTING COMBUSTIBLE MATERIAL TO SYNTHESIS GAS

RELATED APPLICATIONS

This application claims the benefit of Provisional Patent Application No. 62/210,979 filed Aug. 27, 2015.

BACKGROUND OF THE INVENTION

1. Field of the Invention

The present invention relates generally to plasma arc reactors and systems. More particularly, the present invention relates to a modular plasma arc reactor and related methods of creating hybrid arc plasmas to gasify heterogeneous materials to produce synthesis gas. A synthesis gas consists mainly of carbon monoxide (CO) and hydrogen ($H_2$).

2. Prior Art Description

A plasma is commonly defined as a collection of charged particles containing equal numbers of positive ions and electrons, as well as excited neutrals. Although exhibiting some properties of a gas, a plasma is also a good conductor of electricity and can be affected by a magnetic field. One way to generate a plasma is to pass a gas through an electric arc. The arc heats the gas by resistive and radiative heating to very high temperatures within a fraction of a second. Essentially, any gas may be used to produce a plasma in such a manner. Thus, inert or neutral gases (e.g., argon, helium, neon, or nitrogen) may be used. Reductive gases (e.g., hydrogen, methane, ammonia, or carbon monoxide) may also be used, as may oxidative gases (e.g., oxygen or carbon dioxide) depending on how the plasma is to be utilized.

Plasma generators, including those used in conjunction with, for example, plasma torches, plasma jets and plasma arc reactors, generally create an electric discharge in a working gas to create the plasma. Plasma generators have been formed as direct current (DC) plasma generators, alternating current (AC) plasma generators, radio frequency (RF) plasma generators and microwave (MW) plasma generators. Plasmas generated with RF or MW sources are called inductively coupled plasmas. For example, an RF-type plasma generator includes an RF source and an induction coil surrounding a working gas. The RF signal sent from the source to the induction coil results in the ionization of the working gas by induction coupling to produce the plasma. DC and AC type generators may include two or more electrodes (e.g., an anode and cathode) with a voltage applied between them. An arc may be formed between the electrodes to heat and ionize the surrounding gas such that the gas obtains a plasma state. The resulting plasma may then be used for a specified process application.

Plasma reactors can be used for the high-temperature heating of material compounds to accommodate chemical or material processing. Such chemical and material processing may include the reduction and decomposition of hazardous materials. In other applications, plasma reactors have been utilized to assist in the extraction of a desired material, such as a metal or metal alloy, from a compound that contains the desired material.

Process applications utilizing plasma generators are often specialized. Consequently, the associated plasma reactors need to be designed and configured according to highly specific criteria. Such specialized designs often result in a device with limited usefulness. In other words, a plasma reactor which is configured to process a specific type of material using a specified working gas is not likely to be suitable for use in other processes wherein a different material is being processed using a different working gas.

In view of the shortcomings in the art, a need exists for a plasma reactor and associated system that has adjustable controls and provides improved flexibility regarding the plasma being generated. For example, it would be advantageous to provide a plasma reactor and system that enables the direct processing of solid materials into a gaseous state. It would further be advantageous to provide a plasma reactor and associated system which produces an improved arc and associated plasma column or volume wherein the arc and plasma volume may be easily adjusted and defined to optimize a plasma. These needs are met by the present invention as described and claimed below.

SUMMARY OF THE INVENTION

This invention describes a novel modular DC-DC hybrid plasma reactor system for industrial applications including gasification of biomass and non-biomass combustible materials to produce synthesis gas. Synthesis gas is mainly composed of CO and $H_2$. The plasma reactor creates a large uniform high temperature (>7000° K) plasma with tailored long residence time for materials processing. The plasma reactor has multiple sets of long electrodes that are placed longitudinally opposite each other within modular plasma units. The plasma units can be stacked to form an elongated plasma zone. Materials can continuously flow from one modular plasma unit into the next. In this configuration, an energy cascading effect is created. Due to the cascading energy from upstream plasma units, the bottom-most modular plasma unit produces the brightest plasma illumination.

Each plasma unit defines an internal plasma zone that is accessible through access ports. Electrode assemblies extend into the access ports. Each of the electrode assemblies has an electrode tip that is positioned within the internal plasma zone at a selected insertion depth. Each electrode tip is mounted in a tubular support jacket. A gas conduit for a supplied working gas surrounds at least a portion of the tubular support jacket. An arc is created at the electrode tip. A working gas flows through the gas conduit and is directed into the arc, therein creating plasma within the internal plasma zone.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention plasma gasifier can be embodied in many ways, only one exemplary embodiment has been selected for the purposes of illustration and discussion. The exemplary embodiment represents one of the best modes contemplated for the invention. The illustrated embodiment, however, is merely exemplary and should not be considered a limitation when interpreting the scope of the claims.

Figure 1:
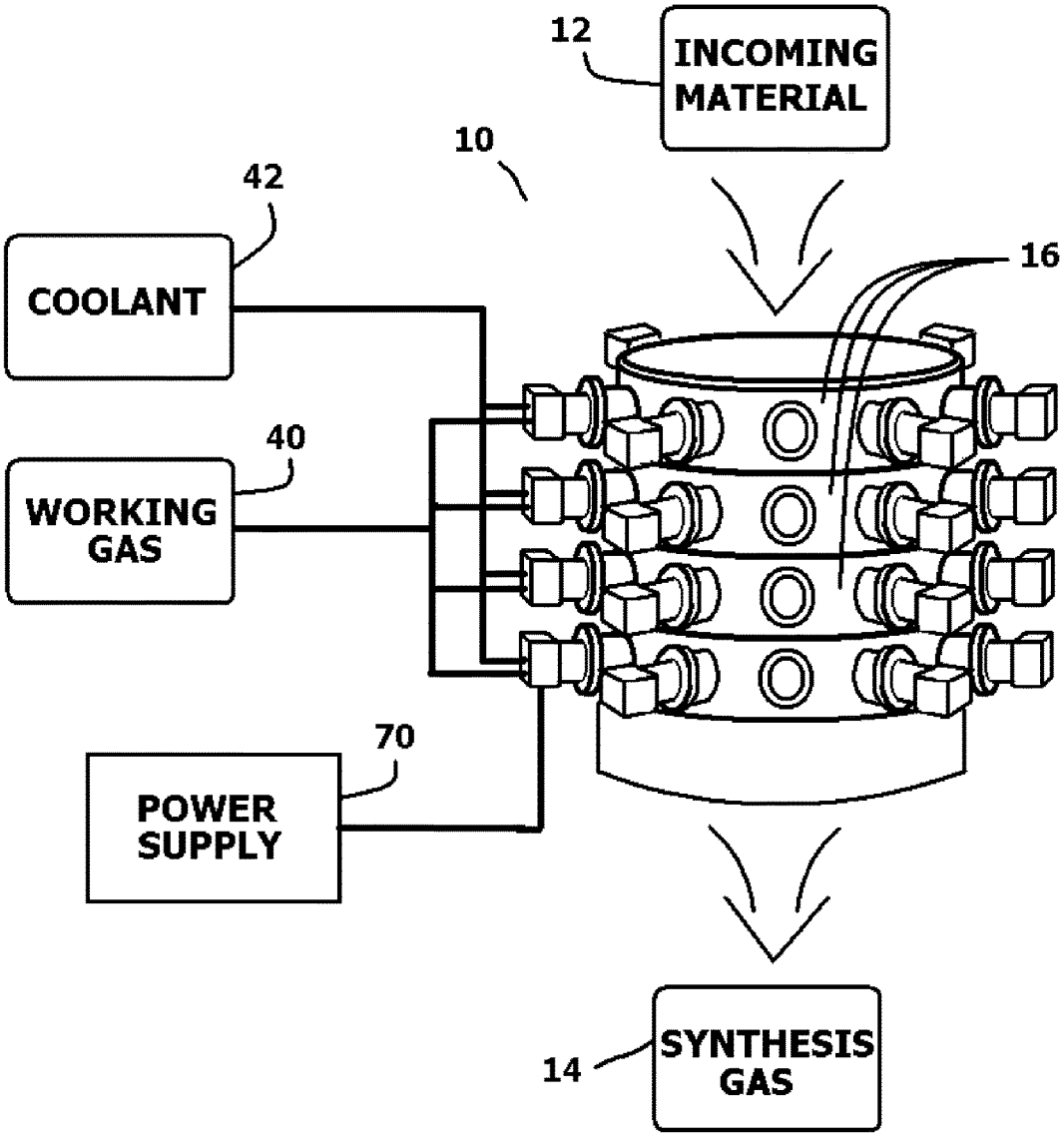
FIG. 1 is a front view and schematic of an exemplary embodiment of a plasma gasifier apparatus containing multiple plasma units.
Figure 2:
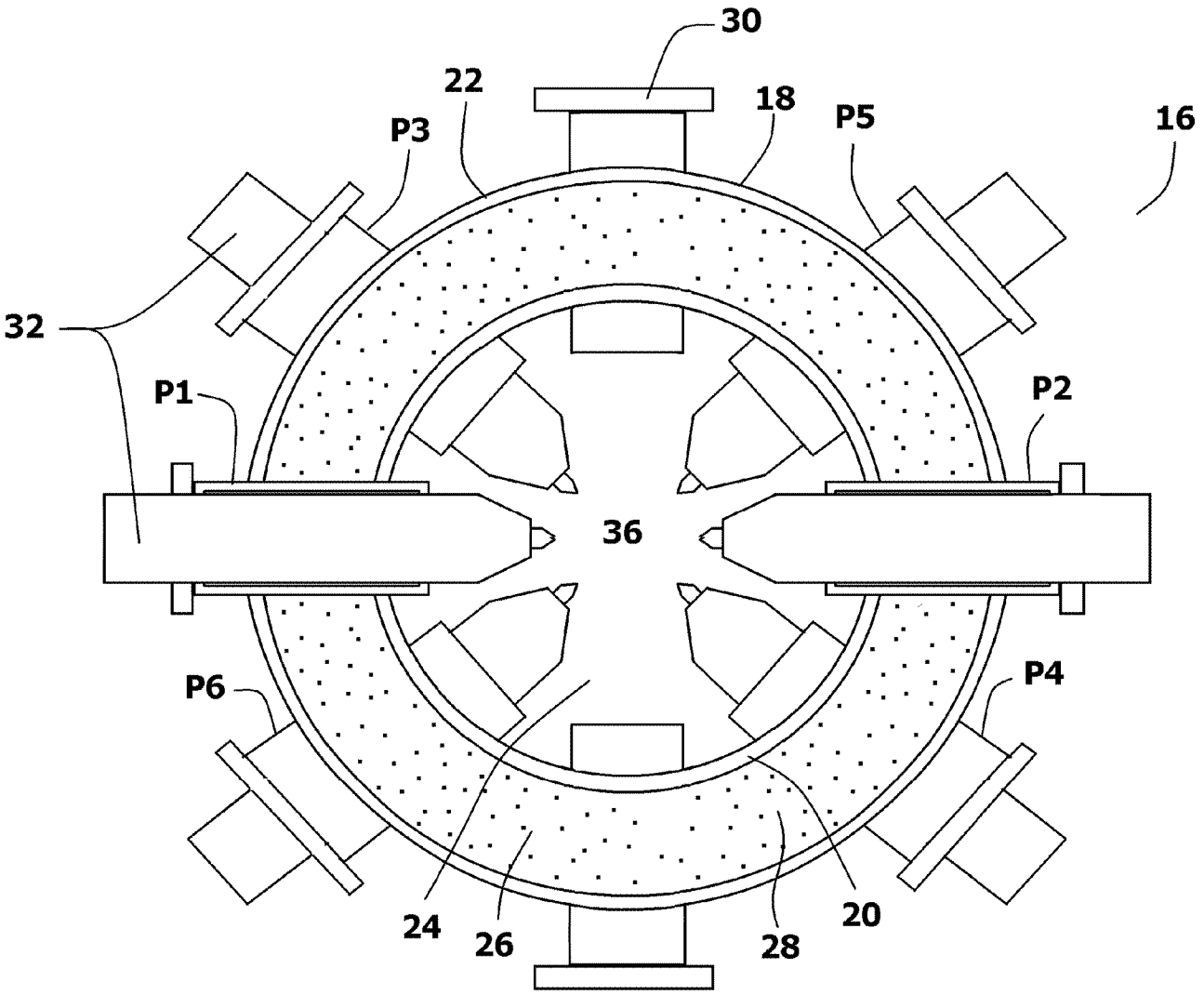
FIG. 2 is a selectively cross-sectioned top view of a plasma unit used in the exemplary embodiment of a plasma gasifier apparatus.

Referring to FIG. 1 in conjunction with FIG. 2, a plasma gasifier apparatus 10 is shown that internally generates a hybrid plasma. The plasma is used to process incoming material 12 and convert that incoming material into a synthesis gas 14. The plasma gasifier apparatus 10 contains one or more plasma units 16 that are concentrically stacked. Although one plasma unit 16 can be used, performance is optimized through the use of a plurality of plasma units 16. In this description, the term "hybrid" is used to refer to a "field free" (current and voltage free) plasma flame from one or more of the plasma units 16 to a "field active" (current and voltage active) arc state by superimposing an electric discharge within one or more plasma units 16.

In FIG. 1, the plasma gasifier apparatus 10 is shown containing four stacked plasma units 16. It should be understood that in actuality the plasma gasifier apparatus 10 can have any plurality of stacked plasma units 16. By stacking the plasma units 16, the plasma zone within the plasma gasifier apparatus 10 is lengthened. This produces an increase in the processing time for the incoming materials 12 introduced into the plasma gasifier apparatus 10. The modular configuration created by stacking plasma units 16 enables an operator to manipulate the power settings in each of the plasma units 16 to achieve an overall temperature profile for the plasma gasifier apparatus 10. An operator can also add or subtract modular plasma units 16 to achieve the desired residence time for complete gasification of a particular class of incoming material 12.

Referring to FIG. 2 in conjunction with FIG. 1, each plasma unit 16 has an annular body 18 with an inner wall 20 and an outer wall 22. The inner wall 20 defines a central plasma zone 24. The inner wall 20 is refractory and capable of containing the heat of the plasma without degradation. A preferred material for the inner wall 20 is graphite, however, certain refractory ceramics can also be used. A gap space 26 exists between the inner wall 20 and the outer wall 22. The gap space 26 is packed with insulation 28, such as high temperature ceramic fibers. In one embodiment of the insulation 28, the ceramic fibers are, but not limited to, Zirconia fibers. Alternatively, granulated sand and/or granulated oxide materials can also be used as the insulation 28. Ceramic fibers or granulated oxide materials have significant advantages over conventional solid high-density blocky oxide insulations. Granulated oxides and/or ceramic fiber blankets are very low-density packing materials. There are significant voids in these materials. The voids have very low thermal conductivity and have excellent thermal insulation properties. Very low-density thermal insulation materials also reduce the overall weight of the gasifier apparatus 10.

The annular bodies 18 and central plasma zones 24 concentrically align when the plasma units 16 are stacked. The central plasma zone 24 of each plasma unit 16 is accessible through a plurality of access ports 30. Preferably, each plasma unit 16 contains at least eight access ports 30. Each of the access ports 30 is also lined with a sleeve of refractory material, such as graphite, that can maintain integrity in the heat field of plasma.

Most of the access ports 30 in each of the plasma units 16 receive electrode assemblies 32. Each of the electrode assemblies 32 is surrounded by an insulator 34 that is sized to pass into the access ports 30 with tight tolerances. The tolerances prevent any significant gaps from existing between the insulator 34 and the interior of the access port 30 that can leak plasma out of the plasma gasifier apparatus 10. As will later be explained in more detail, each of the electrode assemblies 32 contains an electrode tip 36 and a gas conduit 38 (shown in FIG. 4). The electrode tip 36 extends into the central plasma zone 24 and creates an arc with another electrode tip during operation. The gas conduit 38 introduces a working gas 40 into the plasma zone 24 that is converted into plasma by the arc. Each of the electrode assemblies 32 is cooled by a coolant 42. As such, it will be understood that each of the electrode assemblies 32 is coupled to a power supply 44 to receive electricity, a gas supply to receive the working gas 40, and a coolant supply to receive coolant 42.

Each plasma unit 16 receives the electrode assemblies 32 in sets of two. As such, each plasma unit 16 can receive two, four, six, eight or more of the electrode assemblies 32, depending upon the number of access ports 30 present. A first set of electrode assemblies 32 are set at a first position P1 and a second position P2 on opposite sides of the central plasma zone 24. Likewise, a second set of electrode assemblies 32 are set at positions P3 and P4. A third set of electrode assemblies 32 are set at positions P5 and P6. Accordingly, there are three sets of electrode assemblies 32 in the exemplary embodiment. Each set of electrode assemblies 32 contains one anode electrode and one cathode electrode.

The positions P1, P2 of the first set of electrode assemblies 32 are disposed radially or circumferentially to the positions P3, P4 of the second set of electrode assemblies 32 and the positions P5, P6 of the third set of electrode assemblies within each plasma unit 16. The angle of separation between the electrode assemblies 32 of the second set and the electrode assemblies 32 of the third set is 90 degrees. The angle of separation between the electrode assemblies 32 of the first set and the electrode assemblies 32 of the second set is 45 degrees. The angle of separation between the electrode assemblies 32 of the first set and the third set is also 45 degrees.

Figure 3:
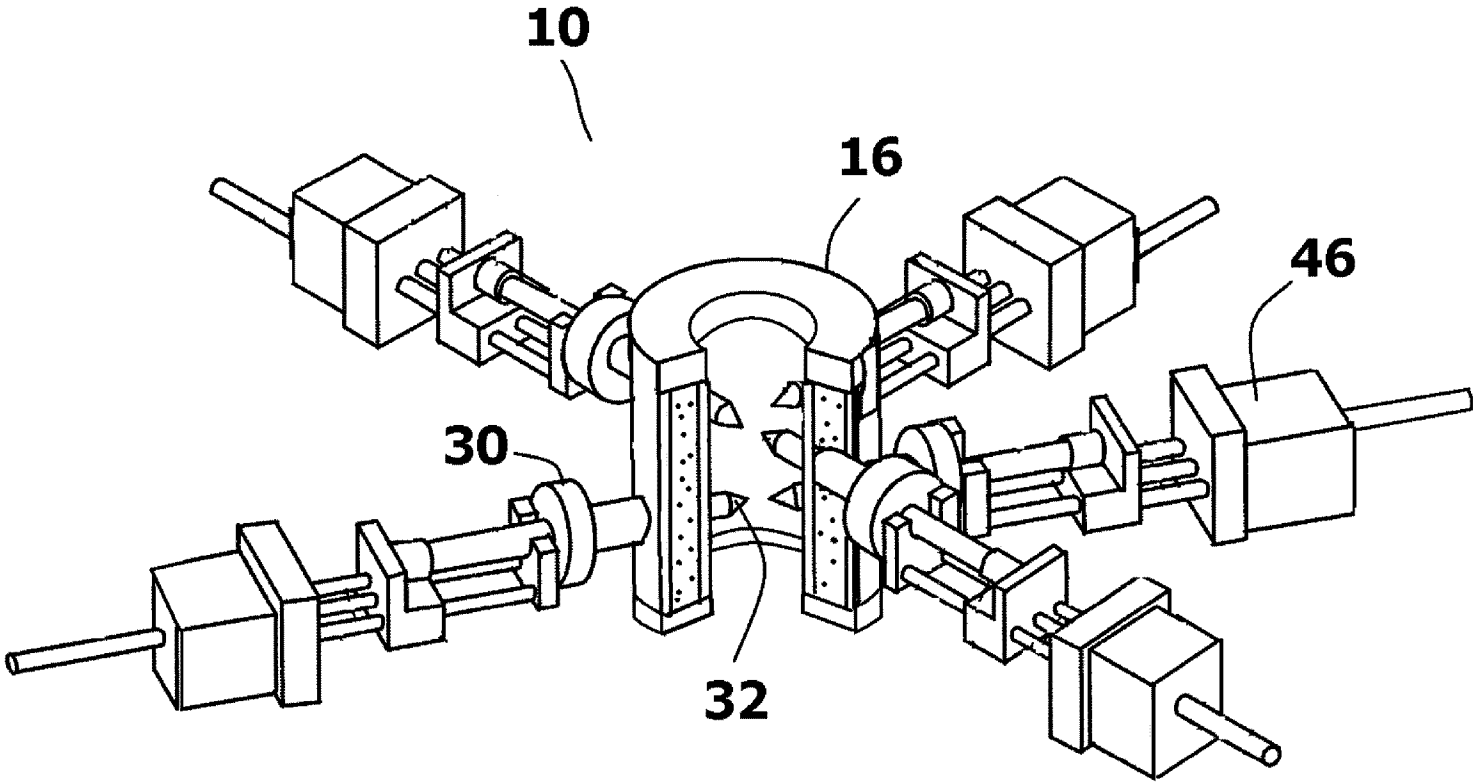
FIG. 3 is a fragmented perspective view of a plasma unit used in the exemplary embodiment of a plasma gasifier apparatus.

Referring to FIG. 3 in conjunction with FIG. 2, it will be understood that each of the electrode assemblies 32 can reciprocally move within the confines of the access ports 30. The reciprocal movements are controlled by a corresponding linear actuator 46 that attaches to each of the electrode assemblies 32. Each set of electrode assemblies 32 can be moved synchronously to or independent of each other. In a single plasma unit 16, the separation (arc gap) between any set of electrode assemblies 32 can be adjusted by moving those electrode assemblies 32 into, or out of, the access ports 30.

In the exemplary embodiment, three sets of electrode assemblies 32 are inserted into each plasma unit 16 through the access ports 30. Preferably, at least two of the access ports 30 are used for observations of the plasma gasifier apparatus 10 in operation. Electrode assemblies 32 attach to the access ports 30 that are not being used for observation. Each of the electrode assemblies 32 has the linear actuator 46 that controls the movements of the electrode assemblies 32 into and out of the access ports 30.

Figure 4:
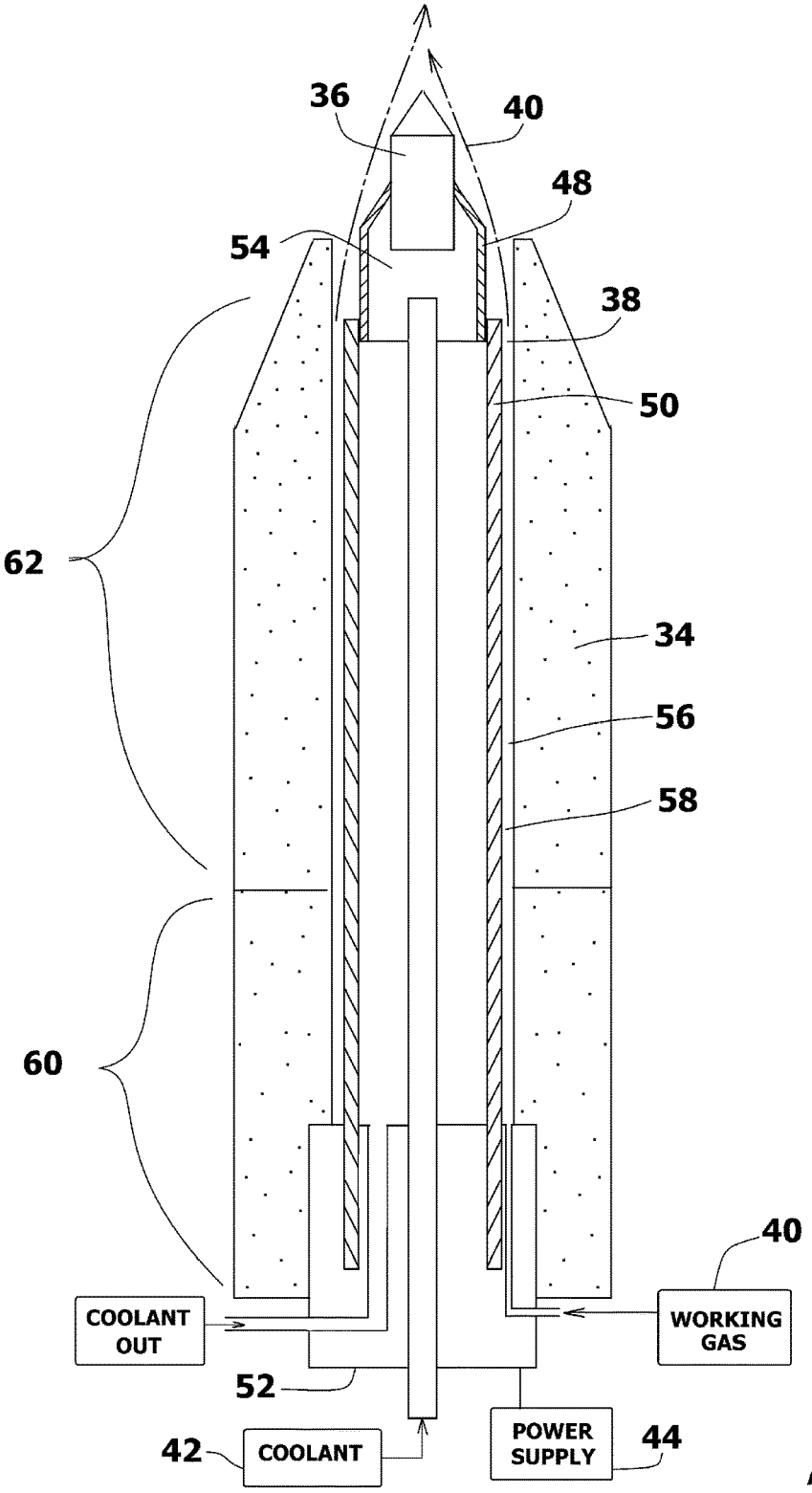
FIG. 4 shows a cross-sectional view of an electrode assembly used within the plasma gasifier apparatus.

Referring to FIG. 4, it can be seen that each of the electrode assemblies 32 used in the plasma gasifier apparatus 10 includes an electrode tip 36. The electrode tip 36 is made of a tungsten alloy or some other common plasma electrode material. The electrode tip 36 is mounted to the end of a tubular support jacket 48, therein sealing one open end of the tubular support jacket 48. The opposite open end of the tubular support jacket 48 is mounted to the top of a conductive tube 50. The conductive tube 50 is coupled to an electrode base 52, wherein the electrode base 52 receives current from the power supply 44. Any current received at the electrode base 52, travels through the electrode base 52 and into the conductive tube 50. The current flows through the conductive tube 50 and into the tubular support jacket 48. The current then flows through the material of the tubular support jacket 48 and into the electrode tip 36.

The conductive tube 50 and the tubular support jacket 48 combine to define a common internal cooling compartment 54. The coolant 42 is introduced into the cooling compartment 54 from an external supply. The coolant 42 flows through the conductive tube 50, the tubular support jacket 48 and around much of the electrode tip 36 itself. In this manner, the coolant 42 directly cools the electrode tip 36, the tubular support jacket 48 and the conductive tube 50 during operation.

The insulator 34 is positioned around the conductive tube 50 and most of the tubular support jacket 48. The insulator 34 defines a central conduit 56. The conductive tube 50 and the tubular support jacket 48 extend through the central conduit 56. A gap space 58 exists between the interior of the central conduit 56 and the exterior surfaces of the conductive tube 50 and the tubular support jacket 48. The gap space 58 is open proximate the electrode tip 36. The working gas 40 used in creating the plasma is supplied into the gap space 58. The working gas 40 travels through the gap space 58 and exits the electrode assembly 32 in a circle around the electrode tip 36.

The insulator 34 can be homogenous. However, it is preferred that the insulator 34 be an assembly. In the shown embodiment, the insulator 34 includes a front-end ceramic section 62 and a back-end plastic section 60. The two sections 60, 62 connect linearly to create the tubular body of the insulator 34.

As previously stated, the working gas 40 exiting the gap space 58 is ejected in a circle around the electrode tip 36. The generation of plasma is the most effective when the working gas 40 exiting around the electrode tip 36 does not disperse away from any arc that is emanating from the electrode tip 36. The best way to ensure that the working gas 40 remains in a tight stream is to eject the working gas 40 in a directed laminar flow, rather than a random turbulent flow.

Figure 6:
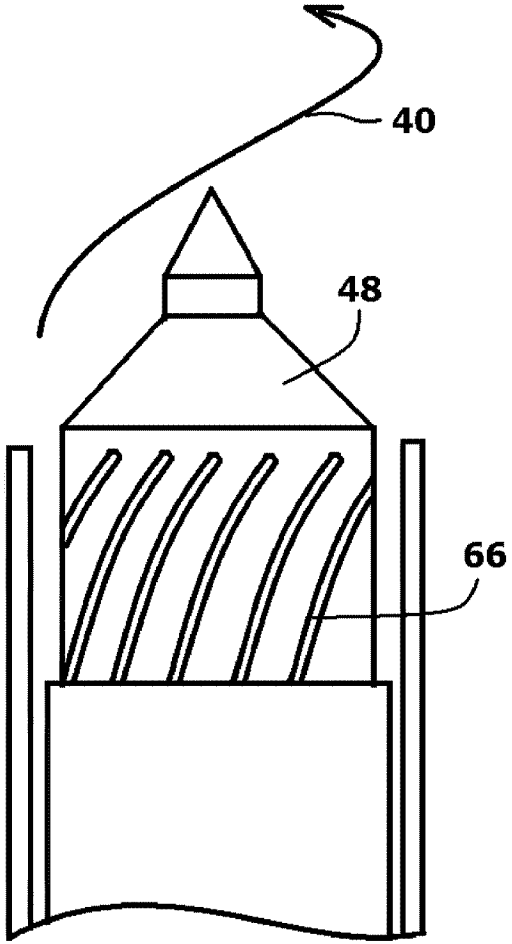
FIG. 6 shows a second configuration for a tubular support jacket within the electrode assembly.
Figure 5:
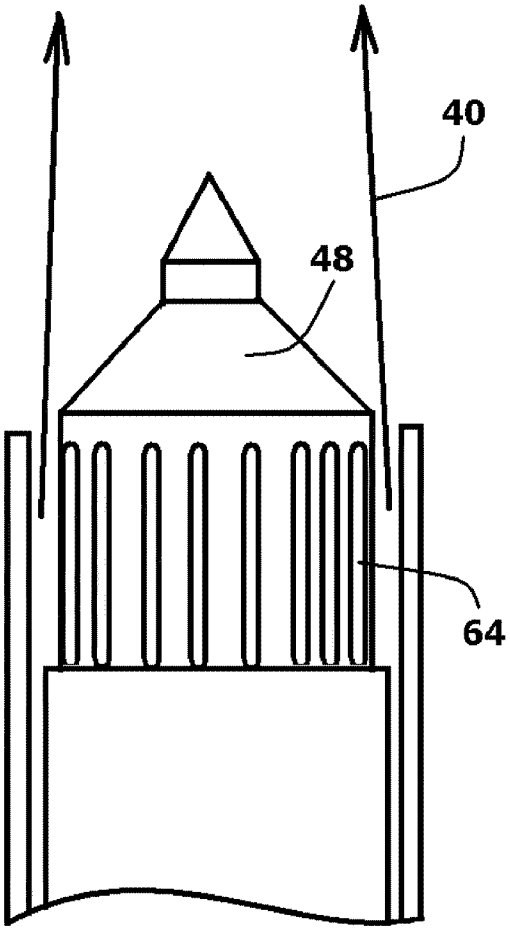
FIG. 5 shows a first configuration for a tubular support jacket within the electrode assembly.

Referring to FIG. 5 and FIG. 6, it will be understood that a laminar flow profile can be induced in the working gas 40 by providing flow channels in the exterior of the tubular support jacket 48. FIG. 5 shows straight flow channels 64. FIG. 5 shows spiral or swirl flow channels 66. As the working gas 40 flows over the flow channels 64, 66, the working gas 40 is provided with a directed flow, be it straight or spiral. This directed flow tends to be laminar or swirl for the flow rates being used. The directed flow of the working gas 40 through the flow channels 64, 66 has other unique performance characteristics. The tubular support jacket 48 is preferably made of a copper alloy that has a much better thermal conductivity than does the tungsten alloy of the electrode tip 36. The tubular support jacket 48 is therefore a heat sink to the electrode tip 36. As the working gas 40 flows through the flow channels 64, 66, the working gas 40 cools the tubular support jacket 48. This, in turn, cools the electrode tip 36. This reduces over-heating of the electrode tip 36 and prevents excessive consumption and erosion of the electrode tip 36. Furthermore, the high electrical conductivity of the tubular support jacket 48 reduces junction resistive heating within the electrode tip 36. This allows high joule heating to occur at the electrode tip 36 for better thermionic emission of electrons that form and sustain an arc.

Referring back to FIG. 1 and FIG. 2, it will be understood that in operation, each set of electrode assemblies 32 (one anode and one cathode) is coupled to the power supply 44. The electrode assemblies 32 are preferably connected to the power supply 44 through water-cooled cables 70. The water-cooled cables 70 provide both the cooling and current paths for the electrode assemblies 32.

The coolant 42 for each electrode assembly 32 is supplied via a high-pressure pump. After cooling the electrode tip 36, the coolant 42 exits the electrode assembly 32 and is stored in a reservoir. When fresh water is available, the coolant 42 in the reservoir 74 is kept cold by a cooling unit 76, such as a portable water heat exchanger. In another embodiment, when fresh water is not available, the cooling unit 76 can be a chemical based chiller.

Arc Ignition and Plasma Formation

The arc can be ignited by (i) a high voltage discharge, (ii) a high frequency discharge, or by (iii) touching and withdrawing one electrode set from each other.

When high voltage or high frequency discharge is used to ignite an arc, a set of electrode tips 36 is brought in close proximity to each other. After the power supply 44 that supports the electrode assemblies 32 is energized, a high voltage or high frequency discharge is applied across the central plasma zone 24 between electrode tips 36, which ignite an arc.

In a touch and withdrawal method of igniting an arc, the anode and cathode electrode tips 36 from a set of electrode assemblies 32 are brought into contact with each other momentarily after the power supply 44 is energized. As soon as a spark is generated, the electrode assemblies 32 are drawn apart quickly and an arc is ignited.

After a first arc is ignited, a second set of electrode assemblies 32 is moved into the first arc region for ignition. The second set of electrode assemblies 32 requires thermal conditioning for a few seconds in the arc before it is self-ignited. Thermal conditioning is required to heat the electrode tips 36 to a sufficient temperature for thermionic emission of electrons to occur. Different plasma units 16 in the same plasma gasifier apparatus 10 can be used to form a combined arc system. In this method, arc systems complement each other in heating the combined arc plasma to achieve a much higher energy state than is possible using a single plasma unit 16. Additional plasma units 16 in the plasma gasifier apparatus 10 can be ignited in the same way.

The use of a plasma gasifier apparatus 10 with two or more plasma units 16 can generate very large and significantly high temperature arcs within the common plasma zone 24 using relatively low input power from each participating plasma unit 16.

Plasma units 16 can be duplicated and stacked onto one other. In this way, when one or more plasma units 16 sustain arcs there is a field free (absence of current and voltage) high-energy plasma tail flame that can flow into other plasma units 16. In this case the electrode assemblies 32 in other plasma units 16 superimpose discharges in the tail flame and reignite it back into an arc state. The stacked plasma units 16 produce a very large plasma column with very significant energy content.

The modular stacking configuration of plasma units 16 can therefore create a "hybrid plasma". In this concept hybrid means that the "field free" (current and voltage free) plasma flame from the upstream unit is reheated to a "field active" (current and voltage active) arc state by superimposing an electric discharge in the downstream plasma units. The net plasma energy flow from one plasma unit 16 to another is called "energy cascading". Energy cascading adds energy to the downstream plasma units and allows the downstream plasma units to operate with a lower energy requirement.

It will be understood that the embodiments of the present invention that are illustrated and described are merely exemplary and that a person skilled in the art can make many variations to those embodiments. All such embodiments are intended to be included within the scope of the present invention as defined by the claims.

What is claimed is:

1. A plasma gasifier, comprising:

a first plasma unit having access ports, said first plasma unit defining a first internal plasma zone therein, wherein said first internal plasma zone is accessible through said access ports;

electrode assemblies that extend into said access ports, wherein each of said electrode assemblies includes;

an electrode base that receives electrical current;

a conductive tube in contact with said electrode base that conducts said electrical current;

a tubular support jacket that extends from said conductive tube, wherein said conductive tube and said tubular support jacket define an internal compartment that is actively cooled by flowing coolant;

an electrode tip supported by said tubular support jacket and cooled by said flowing coolant in said internal compartment, wherein said electrode tip extends into said first internal plasma zone to an insertion depth, and wherein each said electrode tip receives said electrical current through each said tubular support jacket;

an insulator that surrounds at least a portion of said conductive tube and said tubular support jacket; and a gas conduit for a supplied working gas disposed between said insulator and at least a portion of said tubular support jacket.

2. The plasma gasifier according to claim 1, wherein each said tubular support jacket contains external grooving for directing said supplied working gas passing said tubular support jacket in said gas conduit.

3. The plasma gasifier according to claim 1, wherein each said tubular support jacket is more electrically conductive than is each said electrode tip.

4. The plasma gasifier according to claim 1, further including a linear actuator for each of said electrode assemblies that can selectively move said electrode assemblies within said access ports, therein selectively adjusting said insertion depth of each said electrode tip.

5. The plasma gasifier according to claim 1, further including at least one subsequent plasma unit that defines at least one subsequent internal plasma zone, wherein said at least one subsequent internal plasma zone has subsequent access ports and subsequent electrode assemblies in at least some of said subsequent access ports.

6. The plasma gasifier according to claim 5, wherein said first plasma unit and said at least one subsequent plasma unit are interconnected so that said first plasma zone and said at least one subsequent plasma zone form a single enlarged plasma zone.

* * * * *